US006884141B2

(12) United States Patent
Son

(10) Patent No.: US 6,884,141 B2
(45) Date of Patent: Apr. 26, 2005

(54) FLAT LUMINESCENCE LAMP AND METHOD FOR FABRICATING THE SAME

(75) Inventor: Suk Min Son, Daejon-Kwangyokshi (KR)

(73) Assignee: LG. Philips LCD Co., Ltd., Seoul (KR)

( * ) Notice: Subject to any disclaimer, the term of this patent is extended or adjusted under 35 U.S.C. 154(b) by 9 days.

(21) Appl. No.: 10/754,616

(22) Filed: Jan. 12, 2004

(65) Prior Publication Data

US 2004/0142624 A1 Jul. 22, 2004

Related U.S. Application Data

(62) Division of application No. 09/893,554, filed on Jun. 29, 2001.

(30) Foreign Application Priority Data

Dec. 22, 2000 (KR) ..... 2000-80211

(51) Int. Cl.[7] ..... H01J 9/00
(52) U.S. Cl. ..... 445/24

(58) Field of Search ..... 445/24

(56) References Cited

U.S. PATENT DOCUMENTS

| | | | | | |
|---|---|---|---|---|---|
| 4,254,360 | A | * | 3/1981 | Haven | 313/395 |
| 5,831,374 | A | | 11/1998 | Morita et al. | 313/46 |
| 5,957,743 | A | | 9/1999 | Konishi et al. | 445/24 |
| 6,140,759 | A | | 10/2000 | Sreeram et al. | 313/493 |
| 6,414,434 | B1 | * | 7/2002 | Nakano et al. | 445/43 |

* cited by examiner

*Primary Examiner*—Nimeshkumar D. Patel
*Assistant Examiner*—Sharlene Leurig
(74) *Attorney, Agent, or Firm*—Morgan, Lewis & Bockius, LLP

(57) ABSTRACT

A flat luminescence lamp includes a first substrate having a first surface and a second surface, a second substrate having a first surface disposed facing opposite to the first surface of the first substrate, a first luminescence layer formed on the first surface of the first substrate, a second luminescence layer formed on the first surface of the second substrate, and a plurality of grooves formed on the second surface of the first substrate.

9 Claims, 6 Drawing Sheets

FLAT LUMINESCENCE LAMP AND METHOD FOR FABRICATING THE SAME

This is a divisional of copending application No. 09/893,554, filed on Jun. 29, 2001.

The present application claims the benefit of Korean Patent Application No. P2000-80211 filed on Dec. 22, 2000 in Korea, which is hereby incorporated by reference.

BACKGROUND OF THE INVENTION

1. Field of the Invention

The present invention is related to a luminescence lamp, and more particularly, to a flat luminescence lamp and a method for fabricating the same.

2. Background of the Related Art

Extra slim flat panel display devices that have a thickness less than a few centimeters have diverse areas of application, such as liquid crystal displays (LCDs) for notebook computers, monitors, spacecraft, and airplanes. Of the many different types of LCDs, the passive luminescence type LCD includes a backlight to be used as a light source disposed at the rear of a LCD panel. However, the use of such backlights in LCDs is inefficient in view of their weight, power consumption, and thickness.

Backlights that are commonly used in LCD devices are generally cylindrical fluorescent lamps disposed beneath a LCD panel. However, the fluorescent lamp must be spaced from the LCD panel in order to prevent the fluorescent lamp from being seen on the LCD panel. Accordingly, a light scattering mechanism is required to provide a uniform distribution of light across an entire surface of the LCD panel. Moreover, the specific type of fluorescent lamp disposed beneath the LCD panel limits the fabrication process of making a thin LCD panel. When a large-sized fluorescent lamp size is disposed beneath the LCD, a larger area of the light emitting surface is required.

In a LCD device using a fluorescent lamp fitted with a light plate, the fluorescent lamp is disposed to an outer circumference of the LCD panel for scattering light to an entire surface of the LCD panel. By using the light plate, a total luminance of the fluorescent lamp is low since the light must transmit through the light plate. Moreover, to ensure uniform distribution of the light upon the LCD panel, a high degree of optical design and fabrication technologies are required. Currently, a fluorescent lamp disposed beneath the LCD is suggested in which a number of individual lamps, or a single lamp that has multiple bends, are disposed beneath a display surface of the LCD panel.

A typical flat luminescence lamp will be explained with reference to FIGS. 1 and 2. FIG. 1 shows a plan view of a flat luminescence lamp according to the related art, and FIG. 2 shows a cross-sectional view across line I—I' of FIG. 1.

In FIG. 1, a luminescence lamp of the related art is provided with a lower plate 11 and an upper plate 11*a*, a cathode electrode 13 disposed upon the lower plate 11, an anode electrode 13*a* disposed upon the upper plate 11*a*, a rectangular frame that includes four frame portions 19*a*, 19*b*, 19*c*, and 19*d* sealing the upper plate 11*a* and the lower plate 11 by solder means, such as glass solder, and a plurality of supporting bars 21 disposed between the lower plate 11 and the upper plate 11*a*.

The anode electrode 13*a* includes multiple portions that are arranged at fixed intervals in pairs of two, and the cathode electrode 13 includes single portions that are arranged at fixed intervals upon the lower plate 11 facing opposite to a space of the upper plate between the anode electrode 13*a*. The cathode electrode 13 and the anode electrode 13*a* are covered with dielectric material, and each has lead lines electrically connected thereto for applying external voltages. The upper plate 11*a* and the lower plate 11 each have surfaces covered with fluorescent material and are disposed to opposite to each other with a discharge space formed therebetween. The discharge space includes xenon Xe gas that forms a plasma to emit UV rays when the external voltages are applied to the cathode electrode 13 and the anode electrode 13*a*. The UV rays collide with the fluorescent material disposed upon both the upper plate 11*a* and the lower plate 11, and excite the fluorescent material to generate visible light. Additionally, a reflective plate 14 is disposed above the cathode electrode 13 to prevent any light generated within the discharge space from leaking toward a back surface of the lower plate 11. Accordingly, the supporting bars 21 are formed of glass for transmitting the light.

In FIG. 2, the lower plate 11, which is made of glass, includes the cathode electrode 13 and a dielectric material layer 12 formed to cover the cathode electrode 13. The reflective plate 14 is disposed upon the first dielectric material layer 12, and a first fluorescent layer 15 is disposed upon the reflective plate 14. The anode electrode 13*a* is disposed upon the upper plate 11*a*, which is also made of glass, for inducing a discharge in association with the cathode electrode 13. A second dielectric material layer 12*a* is disposed upon the upper plate 11*a* to cover the anode electrodes 13*a*, and a second fluorescent material layer 15*a* is disposed upon the second dielectric material layer 12*a*. The frame portions 19*a*, 19*b*, 19*c*, and 19*d* are all formed between the upper plate 11*a* and the lower plate 11 for sealing the upper plate 11*a* and the lower plate 11 by glass solder. A flat heat dissipation plate 23 is disposed upon a back surface of the lower plate 11 for dissipating heat that is generated during discharge to an exterior of the lamp. The cathode electrode 13 and the anode electrode 13*a* are formed by either a silk print process or a vapor deposition process. Upon the application of the external voltage to the cathode electrode 13 and the anode electrode 13*a* via the lead lines, the xenon Xe gas within the discharge space disposed between the cathode electrodes 13 and the anode electrodes 13*a* forms a plasma. Accordingly, the plasma emits UV rays that collide with the first fluorescent material layer 15 and the second fluorescent material layers 15*a* to generate visible light, thereby illuminating the flat luminescence lamp.

However, implementing the flat luminescence lamp as described in a lightweight display, such as a notebook PC, increases thickness and weight since it uses two glass plates for the upper lower plates as well as a heat dissipation plate on the back surface of the lower plate.

SUMMARY OF THE INVENTION

Accordingly, the present invention is directed to a flat luminescence lamp and a method for fabricating a flat luminescence lamp that substantially obviate one or more of the problems due to limitations and disadvantages of the related art.

An object of the present invention is to provide a flat luminescence lamp that does not require a separate heat dissipation plate.

Another object of the present invention is to provide a flat luminescence lamp and a method for fabricating a flat luminescence lamp that can improve heat dissipation efficiency.

Another object of the present invention is to provide a flat luminescence lamp with reduced weight and thickness.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a flat luminescence lamp includes a first substrate having a first surface and a second surface, a second substrate having a first surface disposed facing opposite to the first surface of the first substrate, a first luminescence layer formed on the first surface of the first substrate, a second luminescence layer formed on the first surface of the second substrate, and a plurality of grooves formed on the second surface of the first substrate.

In another aspect, a flat luminescence lamp includes a first substrate having a first surface and a second surface, a plurality of grooves formed on the second surface of the first substrate, a second substrate having a first surface and a second surface, the first surface of the first substrate opposing the first surface of the second substrate, a plurality of first electrodes formed on the first surface of the first substrate, a plurality of second electrodes formed on the first surface of the second substrate opposing the first electrodes, a first fluorescent material layer formed on the first surface of the first substrate, a second fluorescent material layer formed on the first surface of the second substrate opposing the first fluorescent material layer, and a plurality of frame portions formed on the first surface of the first substrate and the first surface of the second substrate to seal the first substrate and the second substrate.

In another aspect, a method for fabricating a flat luminescence lamp includes the steps of forming a first substrate having a plurality of grooves on a first surface, forming a plurality of first electrodes on the first substrate, forming a plurality of second electrodes on a second substrate disposed opposite to the first substrate, forming a first fluorescent material layer on a second surface of the first substrate, forming a second fluorescent material layer formed on a surface of the second substrate, and forming a discharge space between the first substrate and the second substrate with a frame disposed between the first substrate and the second substrate.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention: In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
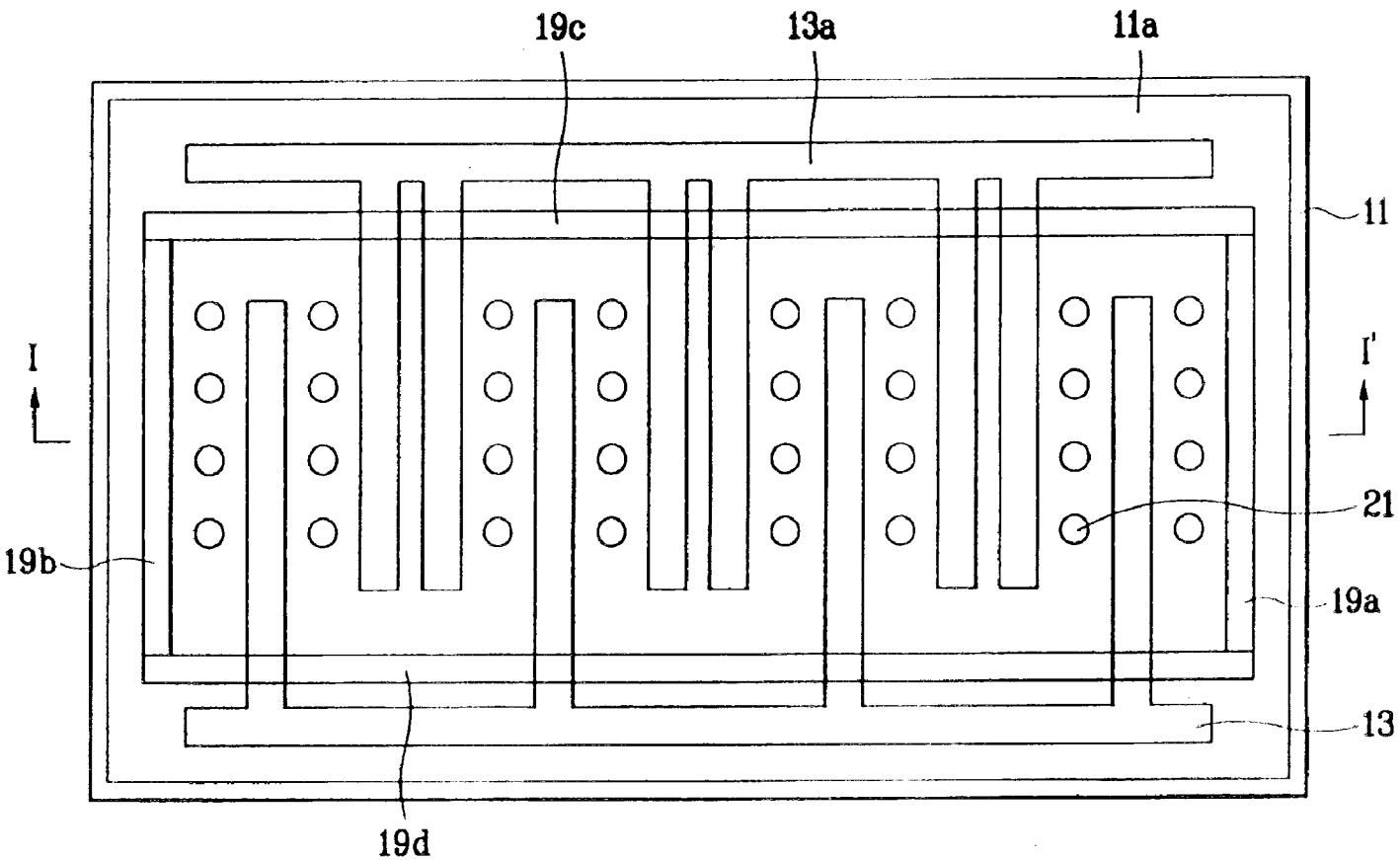
FIG.1 Related Art
FIG. 1 is a plan view showing of a flat luminescence lamp according to the related art.
Figure 2:
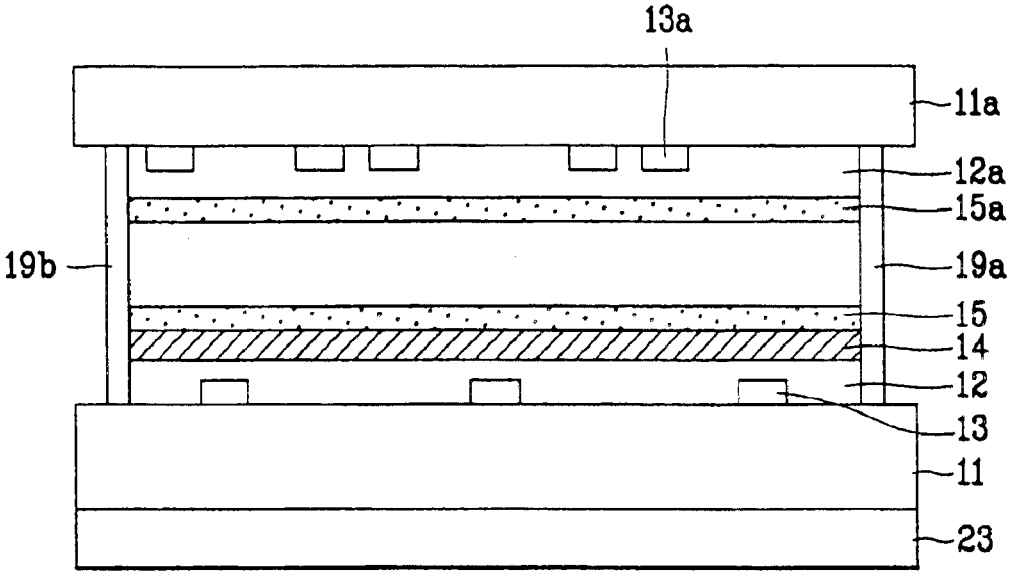
FIG.2 Related Art
FIG. 2 is a cross-sectional view across line I—I' of FIG. 1.
Figure 3:
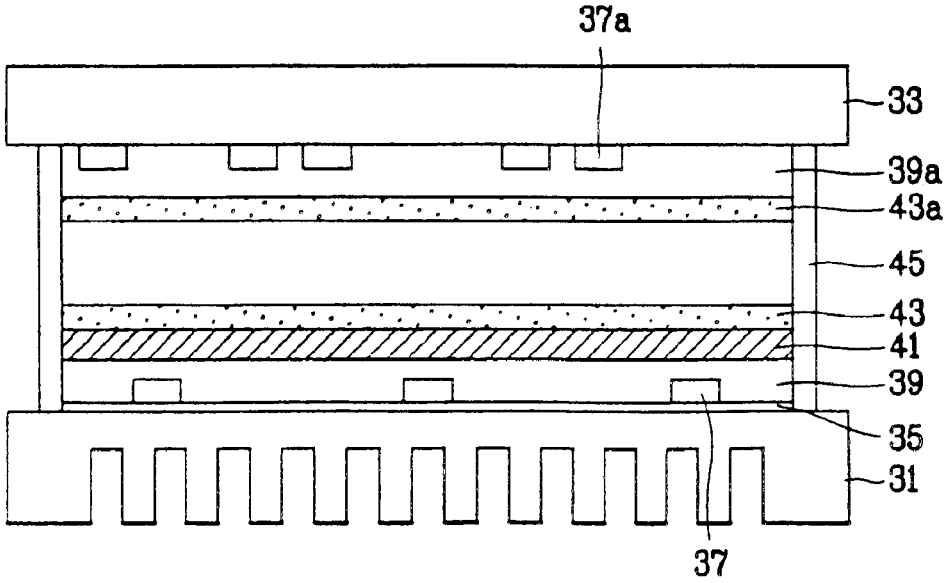
FIG. 3 is a cross-sectional view showing an exemplary flat luminescence lamp in accordance with the present invention.

FIG. 3 shows a cross-sectional view of a flat luminescence lamp in accordance with an embodiment of the present invention. In FIG. 3, the flat luminescence lamp includes a first substrate 31, a second substrate 33, an insulating layer 35 formed upon the first substrate 31, first electrodes 37 formed upon the insulating layer 35 at fixed intervals, a dielectric layer 39 formed upon the insulating layer 35 to cover the first electrodes 37, a first fluorescent material layer 43 formed upon the first dielectric layer 39, second electrodes 37*a* formed upon the second substrate 33, a second dielectric layer 39*a* formed upon the second substrate 33 to cover the second electrodes 37*a*, a second fluorescent material layer 43*a* formed upon the second dielectric layer 39*a*, and a rectangular frame 45 for sealing the first substrate 31 and the second substrate 33. Additionally, a reflective material layer 41 may be formed upon the first dielectric layer 39 for preventing light generated during discharge from leaking toward the first substrate 31. Moreover, the first substrate 31 may be formed of a metal or ceramic, for example, and the second substrate may be formed of glass, for example. The frame may be formed of a paste including a glass material. The first substrate 31 may have a plurality of grooves formed at a back surface thereof for increasing the surface area to increase heat dissipation. The second electrode 37*a* may be formed of a metal or a transparent conductive material, such as ITO (Indium Tin Oxide), for example. Accordingly, since the second electrode transmits the light that is produced as a result of the UV rays colliding with the fluorescent material layer during discharge, a uniform luminescent surface can be obtained over an entire surface of the lamp. Further, a thickness of the insulating layer 35 is provided to electrically insulate the first substrate 31.

Figure 4:
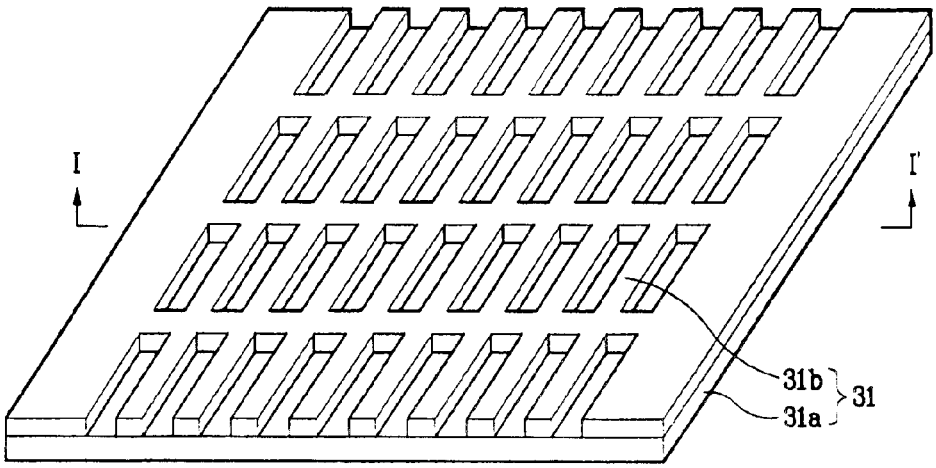
FIG. 4 is a plan view of a first substrate of a flat luminescence lamp in accordance with the present invention.
Figure 5:
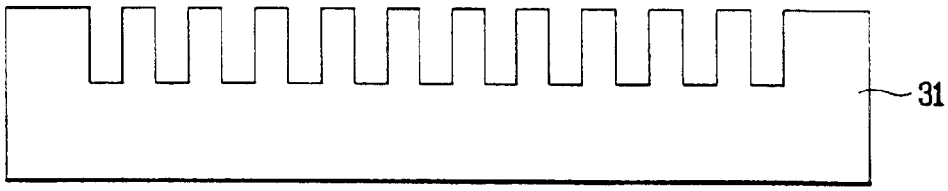
FIG. 5 is a cross-sectional view across line I—I' in FIG. 4.

In FIG. 4, the first substrate 31 of the flat luminescence lamp according to the present invention includes a flat layer 31*a*, and a pattern layer 31*b* formed as a matrix or grating upon the flat layer 3*la*. Since the pattern layer 31*b* is formed as a matrix, the heat generated during discharge may be efficiently dissipated. The pattern layer 31*b* may be formed photolithographically, for example, and may formed in any configuration that efficiently dissipates heat generated during discharge.

A method for fabricating a flat luminescence lamp in accordance with the present invention will be explained with reference to FIGS. 6A to 6F.

Figure 6A:
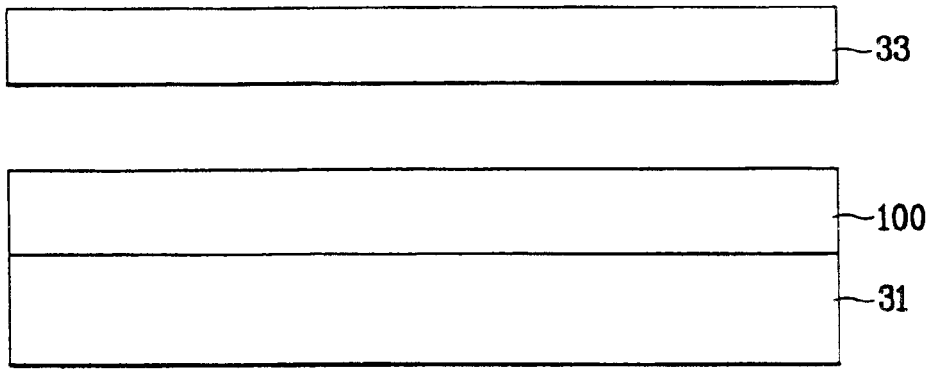
FIGS. 6A to 6F are cross-sectional views showing the method steps for fabricating a flat luminescence lamp in accordance with the present invention.
Figure 6B:
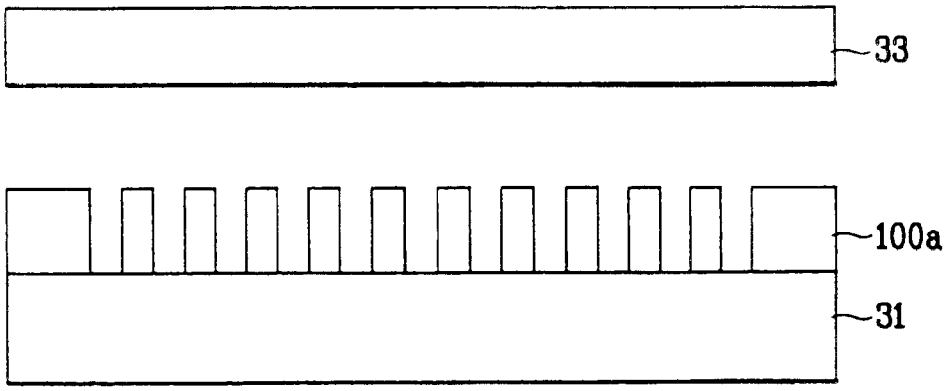

In FIG. 6A, a photosensitive material 100, such as photoresist, may be coated onto a back surface of a first metal substrate 31, and subsequently patterned by exposure and development to form a mask pattern 100*a* of a matrix form, as shown in FIG. 6B.

Figure 6C:
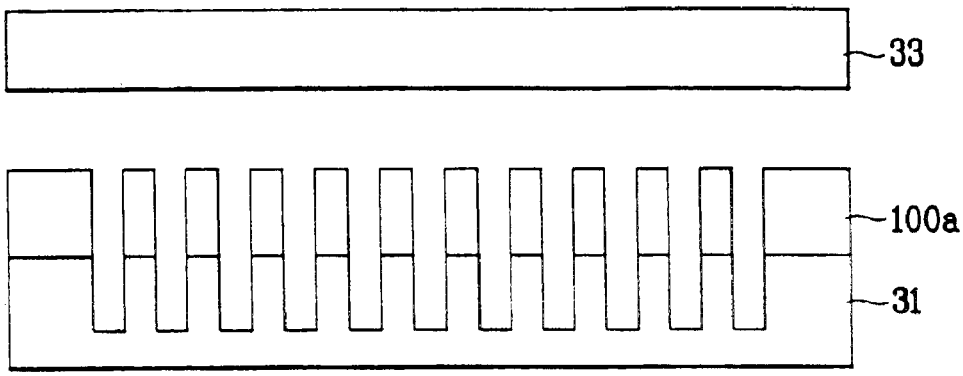

In FIG. 6C, the first metal substrate 31 is etched to a depth by using the mask pattern 100*a* as an etch mask to complete a first substrate 31 with a plurality of grooves formed in a back surface thereof.

Figure 6D:
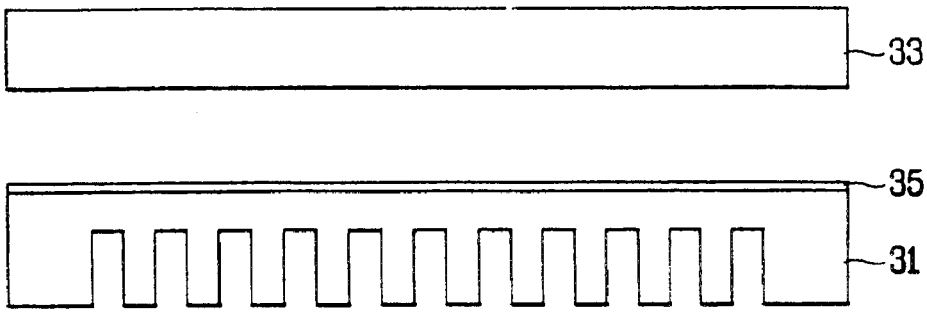

In FIG. 6D, the mask pattern 100*a* is removed and an insulating layer 35 is formed upon the first metal substrate 31. Next, first electrodes 37 are formed upon the insulating layer 35 at fixed intervals, and second electrodes 37*a* are formed upon the second substrate 33. The first electrodes 37 are cathode electrodes, and the second electrodes 37*a* are anode electrodes. The insulating layer 35 is formed to a predetermined thickness to electrically insulate the first substrate from the plurality of first electrodes.

Figure 6E:
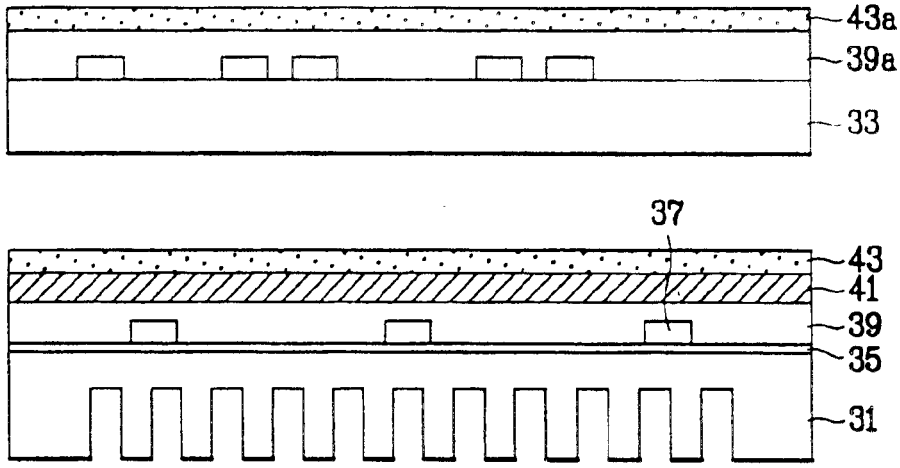

In FIG. 6E, a first dielectric layer 39 is formed upon the insulating layer 35 to cover the first electrode 37, and a second dielectric layer 39*a* is formed upon the second substrate to cover the second electrodes 37*a*. Subsequently, a first fluorescent material layer 43 is formed upon the first dielectric layer 39, and a second fluorescent material layer 43*a* is formed upon the second dielectric layer 39*a*. Additionally, a reflective material layer 41 may be formed before formation of the first fluorescent material layer 43 upon the first dielectric layer 39 to prevent light generated during discharge from leaking toward the first substrate 31.

Figure 6F:
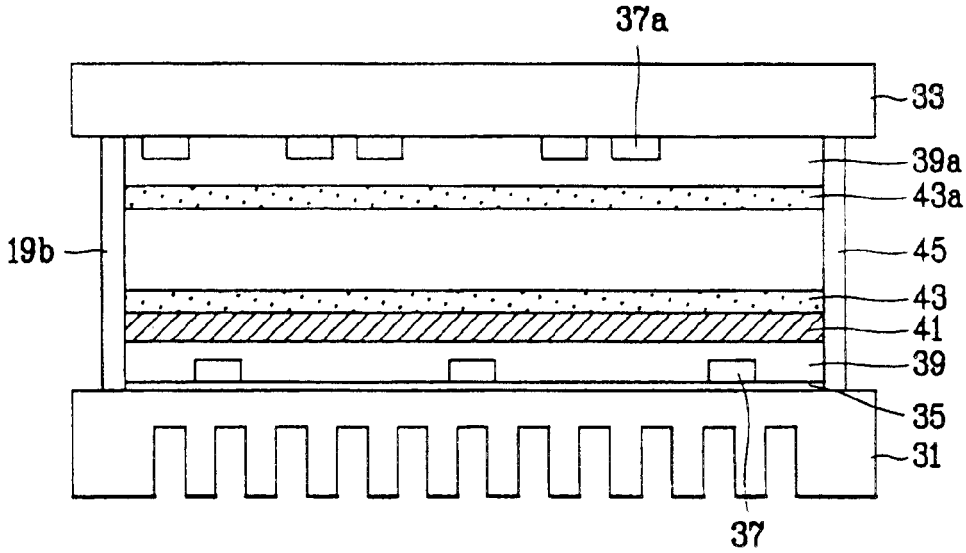

In FIG. 6F, the first substrate 31 and the second substrate 33 are bonded together such that the first fluorescent material layer 43 faces the second fluorescent layer 43*a*, thereby forming a discharge space and a fluorescent gas is subsequently injected through a gas injection opening (not shown). Finally, the first substrate 31 and the second substrate 33 are sealed with solder means, such as glass solder, within a rectangular frame 45 to complete a fabrication process of a flat luminescence lamp of the present invention.

Upon application of an external voltage to the cathode electrode 37, and the anode electrode 37*a*, via lead lines, the fluorescent gas, such as xenon Xe, forms a plasma within the discharge space to emit UV rays that collide with the first fluorescent material layer 43 and the second fluorescent material layer 43*a*, thereby stimulating the emission of visible light.

The flat luminescence lamp of the present invention is not exclusively applicable as a light source for different types of displays, including of LCD device, at a back or front surface thereof, but also deployable as a lighting device itself.

As has been explained, the flat luminescence lamp and the method for fabricating the same have significant advantages over the related art. For instance, use of the flat luminescence lamp according to the present invention means no separate heat dissipation plate is required because metal or ceramic materials, for example, are selected as a first substrate material. As a result, the flat luminescence lamp of the present invention reduces overall weight, thickness, and cost of the LCD device. Furthermore, the plurality of grooves formed in the back surface of the first substrate permits efficient dissipation of heat generated during discharge.

It will be apparent to those skilled in the art that various modifications and variations can be made in the flat luminescence lamp and the method for fabricating a flat luminescence lamp of the present invention without departing from the spirit or scope of the invention. Thus, it is intended that the present invention cover the modifications and variations of this invention provided they come within the scope of the appended claims and their equivalents.

What is claimed is:

1. A method for fabricating a flat luminescence lamp, comprising the steps of:

forming a first substrate having a plurality of grooves through a first surface of the first substrate;

forming an insulating layer directly upon a second surface of the first substrate;

forming a plurality of first electrodes directly upon the insulating layer;

forming a plurality of second electrodes on a first surface of a second substrate disposed opposite to the second surface of the first substrate;

forming a first fluorescent material layer on the second surface of the first substrate;

forming a second fluorescent material layer formed on the first surface of the second substrate; and forming a discharge space between the first substrate and the second substrate with a frame disposed between the first substrate and the second substrate.

2. The method according to claim 1, wherein the plurality of first electrodes are formed upon the insulating layer.

3. The method according to claim 1, further comprising a step of forming a dielectric material layer between the plurality of first electrodes and the first fluorescent material layer, and forming a second dielectric material layer between the plurality of second electrodes and the second fluorescent material layer.

4. The method according to claim 1, further comprising steps of:

bonding the first substrate and the second substrate to oppose each other after the steps of forming the first and second fluorescent material layers; and injecting a discharge gas into the discharge space between the first substrate and the second substrate.

5. The method according to claim 1, wherein the frame is formed from a paste made of a glass material.

6. The method according to claim 1, wherein the step of forming the first substrate includes the steps of coating a photosensitive material on a first surface of a metal layer, patterning the photosensitive material to form a mask pattern of a matrix form, and etching the metal layer to a depth by using the mask pattern as a mask.

7. The method according to claim 1, wherein the insulating layer is formed to a predetermined thickness to electrically insulate the first substrate from the plurality of first electrodes.

8. The method according to claim 3, further comprising the step of forming a reflective material layer upon the first dielectric material layer.

9. A method of fabricating a flat luminescence lamp, comprising the steps of:

forming a first substrate having a plurality of grooves through a first surface of the first substrate;

forming an insulating layer directly on a second surface of the first substrate;

forming a plurality of first electrodes directly on the insulating layer;

forming a first dielectric layer on the plurality of first electrodes and the insulating layer;

forming a reflective layer on the first dielectric layer;

forming a first fluorescent material layer on the reflective layer;

forming a plurality of second electrodes on a first surface of a second substrate disposed opposite to the second surface of the first substrate;

forming a second dielectric layer on the plurality of second electrodes and the first surface of the second substrate;

forming a second fluorescent material layer on the second dielectric layer; and forming a discharge space between the first substrate and the second substrate with a frame disposed between the first substrate and the second substrate, wherein the frame includes a plurality of frame portions formed on the second surface of the first substrate and the first surface of the second substrate to seal the first substrate and the second substrate.

* * * * *

UNITED STATES PATENT AND TRADEMARK OFFICE

CERTIFICATE OF CORRECTION

PATENT NO. : 6,884,141 B2
APPLICATION NO. : 10/754616
DATED : April 26, 2005
INVENTOR(S) : Suk Min Son It is certified that error appears in the above-identified patent and that said Letters Patent is hereby corrected as shown below:

Title Page

Item (73), Assignee, should read:

--LG Philips LCD Co., Ltd., Seoul (KR); Sang Nong Enterprise Co., Ltd., Seoul (KR); Young Jong Lee, Daejon-Kwangyokshi (KR)--

Signed and Sealed this
Twenty-eighth Day of December, 2010

David J. Kappos

David J. Kappos
*Director of the United States Patent and Trademark Office*